US005740546A

United States Patent [19]

Hooper

[11] Patent Number: 5,740,546

[45] Date of Patent: Apr. 14, 1998

[54] REPOSITORY FOR RADIOACTIVE WASTE-VAULT BACKFILL

[75] Inventor: Alan James Hooper, Gloucester, United Kingdom

[73] Assignee: United Kingdom Nirex Limited, Oxfordshire, United Kingdom

[21] Appl. No.: 596,158

[22] PCT Filed: Jul. 28, 1994

[86] PCT No.: PCT/GB94/01625

§ 371 Date: Feb. 14, 1996

§ 102(e) Date: Feb. 14, 1996

[87] PCT Pub. No.: WO95/05666

PCT Pub. Date: Feb. 23, 1995

[30] Foreign Application Priority Data

Aug. 16, 1993 [GB] United Kingdom ..... 9316995

[51] Int. Cl.[6] ..... G21F 9/00

[52] U.S. Cl. ..... 588/16; 588/17; 106/738; 106/792; 106/817; 405/128; 976/DIG. 323

[58] Field of Search ..... 588/16, 17, 3, 588/4; 405/128; 106/721, 738, 792, 817; 976/DIG. 323, DIG. 324

[56] References Cited

U.S. PATENT DOCUMENTS

| | | | |
|---|---|---|---|
| 4,026,716 | 5/1977 | Urschel, III et al. | 106/738 |
| 4,205,994 | 6/1980 | Moyer, Jr. et al. | 106/738 |
| 4,354,877 | 10/1982 | Kawano et al. | 106/695 |
| 4,773,934 | 9/1988 | Colin | 106/737 |
| 4,950,426 | 8/1990 | Markowitz et al. | 252/633 |
| 5,169,566 | 12/1992 | Stucky et al. | 252/629 |
| 5,328,508 | 7/1994 | Lin | 106/723 |
| 5,340,235 | 8/1994 | Milliken | 405/128 |

FOREIGN PATENT DOCUMENTS

| | | |
|---|---|---|
| 1 207 807 | 7/1986 | Canada . |
| 081 403 | 6/1983 | European Pat. Off. . |
| 0 198 808 | 10/1986 | European Pat. Off. . |
| 417 881 | 3/1991 | European Pat. Off. . |
| 2 628 255 | 9/1988 | France . |
| 38 33 676 | 4/1990 | Germany . |
| 2 128 800 | 1/1986 | United Kingdom . |
| 2 162 223 | 1/1986 | United Kingdom . |
| 2 181 883 | 4/1987 | United Kingdom . |
| 2 216 711 | 10/1989 | United Kingdom . |

OTHER PUBLICATIONS

A. Haworth, et al. "Evolution of the Groundwater Chemistry Around a Nuclear Waste Repository", to be presented at the Scientific Basis for Nuclear Waste Management Symposium of the MRS 1987 Fall Meeting, Boston, U.S.A. 30th Nov.–3rd Dec. 1987.

U. Berner(1), A Thermodynamic Description of the Evolution of Pore Water Chemistry and Uranium Speciation during the Degradation of Cement PSI–Bericht Nr. 62, Jun. 1990.

U.R. Berner(2), Thermodynamic modelling of cement degradation: Impart of redox conditions on radionuclide release; 1992, Cement and Concrete Research, vol. 22, pp. 465–475.

"Management of Radioactive Waste from Nuclear Power Plants" IAEA–TECDOC–276 a paper presented at a seminar on the management of radioactive waste from nuclear power plants organized by the International Atomic Energy Agency and held in Karlsruhe, Oct. 1981.

*Primary Examiner*—Ngoclan Mai

*Attorney, Agent, or Firm*—Westman, Champlin & Kelly, P.A.

[57] ABSTRACT

A method of forming a repository for radioactive waste comprises locating the waste in a subterranean vault and backfilling the vault with a filling material which is water permeable and provides a substantial reservoir of available alkalinity such that any ground water permeating through the filling material to the waste has a pH of at least 10.5.

38 Claims, No Drawings

REPOSITORY FOR RADIOACTIVE WASTE-VAULT BACKFILL

The present invention is concerned with the disposal of radioactive waste and in particular with a method of forming a repository for such waste and with a filling material for use in backfilling such a repository.

Proposals for the disposal of low level and intermediate level radioactive waste materials include the long term disposal of such materials in repositories comprising subterranean vaults. In some proposals natural caves or old mine workings are to be used and in other proposals the vault is excavated specifically for the repository.

There has been particular discussion concerning the selection of the appropriate geological conditions for such repository vaults, particularly with a view to avoiding the possibility of ground water seeping into the vault during the very long storage periods contemplated.

Hitherto, proposals for repository vaults have contemplated backfilling the vault to fill voids between radioactive waste disposal packages with a filling material which is impervious to water or becomes impervious. Grouts which have been proposed for this purpose include mixtures of sand and bentonite. Such materials are proposed for backfilling repository vaults in "Management of Radioactive Waste from Nuclear Power Plants"—IAEA-TECDOC-276, a paper presented at a seminar on the management of radioactive waste from nuclear power plants organised by the International Atomic Energy Agency and held in Karlsruhe, October 1981; and also GB-A-2128800 and EP-A-0198808.

In addition, GB-A-2181883 discloses backfilling a repository vault with a "weak filler" to facilitate the possibility of re-opening the vault to remove stored radioactive packages in the event of some need. In this proposal, voids between storage packages in the vault are first partially filled with removable concrete blocks, and then the interstices between the blocks, the vault and the packages are in turn filled with the "weak filler" which is typically a mixture of bentonire and sand. In all the above mentioned prior art documents, the purpose of the filler is to provide an impervious barrier to ground water seepage into the vault. However in spite of proposals to backfill with impervious material, there remain concerns with the possibility of ground water ingress.

The present invention proposes a method of forming a repository for radioactive waste comprising locating the waste in a subterranean vault and backfilling the vault with a filling material which is water permeable and provides a substantial reservoir of available alkalinity such that any ground water permeating through the filling material to the waste has a pH of at least 10.5. Thus, the present invention takes a different approach and rather than attempt completely to prevent ground water seepage, instead contemplates a filling material which is in fact water permeable but which will so load any water seeping through (called pore water) with alkalinity that any such water permeating through to the contained waste will have a very high pH which will inhibit the solubility of the radioelements in the disposed radioactive waste by amounts up to several orders of magnitude. In essence, the vault backfilling material is designed to provide a large reservior of alkaline material in order to buffer i.e. chemically condition the porewater at a high alkalinity for a time scale of 100,000 years or more.

Preferably the filling material has a buffering capacity such that, for ground water (assumed to be deionised) discharging at a rate of $10^{-10}$ meter per second uniformly into one face of a one meter cube of the filling material, the column of water emerging from the opposite face is buffered at pH 10.5 or above for a column length of $2.5\times10^3$ meters over a period of $10^5$ years or longer.

Preferably also, the filling material has an hydraulic conductivity at 28 days cured in a sealed condition of between $10^{-8}$ to $10^{-10}$ meter per second. The fractional porosity of the filling material may be in the range 0.4 to 0.6, and the pore radius distribution in the range $1\times10^{-3}$ to 1 micron.

Preferably, the vault is excavated in a region having a geology selected to minimise the rate of ground water flow.

The filling material is preferably cementitious and is prepared as a slurry to backfill voids in the vault and then allowed to cure to form said filling material as a weakly bound material having a cube compressive strength at any age up to 50 years of not more than about 15 MPa. Thus, the preferred filling material is indeed a bound material when cured, but has a relatively low strength so as to facilitate the re-excavation of the vault to gain access to or remove waste packages if need should arise.

Desirably the material has a cube strength which is not less than 1.5 MPa after seven days and is preferably not less than 4 MPa after twenty-eight days.

Conveniently, the filling material contains calcium hydroxide and calcium silicate hydrate gel formed by hydration of portland cement and/or lime.

The previously mentioned slurry may comprise 30% to 40% water, 20% to 30% portland cement, 7% to 15% lime and 20% to 40% filler, all percentages being by weight. The filler should be a material that will not reduce the durability of the backfill by deleterious chemical reactions with the other constituents, and is preferably selected to have a low strength. Preferably also the filler has a fineness such as to maintain stability of the slurry and a sorptive action on radioelements leaching from the waste. The preferred slurry has a relatively high water content and using a fine filler helps to prevent excessive bleeding of the slurry prior to full hydration. The filler is conveniently limestone flour.

The fineness of the filler may be such that at least 50%, and preferably at least 80% (or even 95%), passes through a 150 micron sieve. By comparison, for typical building sands used as fillers in mortar mixes only about 20 to 25% of the sand will pass through a 150 micron sieve and generally such fine particles are considered undesirable.

The present invention also proposes a repository for radioactive waste formed by the aforementioned method and a filling material suitable for use in performing the aforementioned method.

In a preferred example, the slurry mix has the following nominal proportions:

| Constituent | Percentage by Weight |
|---|---|
| Water | 35.5% |
| Ordinary portland cement | 26% |
| Lime | 10% |
| Limestone flour | 28.5% |

The preferred mixing procedure for the slurry is as follows. Firstly, all the materials are weigh-batched prior to mixing. Mixing is performed by a high power shear mixer. The materials are added to the mixture in the following sequence: water, cement, lime, limestone flour. Mixing is then continued for a minimum of one minute after addition of the limestone flour.

Preferably, a priming procedure is followed to minimize errors in mixed proportions arising from the dead volume in the mixer which is not completely emptied at the end of the previous batch. Thus, the first batch or part of it may be discharged to waste in order to prime the mixer.

The lime in the mix ensures that the resulting backfilling material has a sufficiently long term alkaline buffering capacity. As mentioned above, it is desired that any ground water permeating to the waste packages will have a pH of at least 10.5 throughout a time scale of 100,000 years or more.

The limestone flour in the mix is primarily a low strength filler. However, it assists the sorption of some radioelements. Desirably, the filling material as a whole acts as a good sorption medium for the main radioelements which could be leached out of the waste.

The high permeability of the resulting back filling material has two benefits. Firstly it permits the flow of water through the backfill and so assists the development of chemical homogeneity in the porewater and the alkaline buffering process. Secondly, the permeability permits the movement of gas that will be generated by the degradation of waste and so minimises the possibility of gas pressurization within the vaults. This is a particular problem with prior art designs which attempt to completely seal off the waste packages using an impervious backfilling material.

The backfilling material described in the present example has been designed to have relatively low strength when cured so that the waste packages could be cut free of the backfilling material using relatively simple techniques such as grit blasting or water jetting, in the event that it was desired to retreive a waste package from a back filled vault. However the backfilling material has sufficient strength to enable the placement and back filling of successive layers within the vaults, with fresh layers of backfill being placed on top of previously cured filling material.

The backfilling material slurry described in this example has a relatively rapid hydration period giving an early strength gain but a low long term strength development. Also the hydration phases determine the chemical properties of the resulting backfilling material and when these are formed at an early stage they can be characterised and their behaviour reliably predicted. When the hydration process is almost complete, then the hydration phases will be modified only slowly as the back fill ages and interacts chemically with the repository environment. It would be more difficult to predict the effects of ageing and chemical interaction if the cement phases were themselves evolving during a long hydration period.

The backfilling material slurry is suitable for mixing, handling, pumping and remote vault filling operations. The slurry is self leveling and compacting and able to infill the spaces between waste packages. Bleed should be not greater than 2% to minimize the formation of voids at waste package interfaces.

The backfilling material slurry may be mixed underground at a mixing station within the repository vault. The grout slurry could be pumped directly along a long pipeline for placement in the vault as required, or pumped into tanks and transported into the vault.

As mentioned previously, the cured backfilling material is relatively low strength, although initial strength build up is relatively rapid. The strength at 90 days is typically between 5 and 7 MPa.

Although limestone flour is the preferred filler, fines made from the rock excavated in forming the repository vault may provide a satisfactory alternative.

I claim:

1. A method forming a repository for radioactive waste comprising locating the waste in a subterranean vault and backfilling the vault with a filling material which is water permeable and provides a substantial reservoir of available alkalinity such that any ground water permeating through the filling material to the waste has a pH of at least 10.5, wherein the filling material is cementitious and is prepared as a slurry to backfill voids in the vault and then allowed to cure to form said filling material as a weakly bound material having a cube compressive strength at any age up to 50 years of not more than about 15 MPa, said slurry comprising 30 to 40% water, 20 to 30% portland cement, 7 to 15% lime and 20 to 40% filler all percentages being by weight.

2. A method as claimed in claim 1 wherein the vault is excavated.

3. A method as claimed in claim 1 wherein the filler used in the cementitious slurry has a fineness such that at least 50% passes through a 150 micron sieve.

4. A method as claimed in claim 3 wherein the fineness of the filler is such that at least 80% passes through a 150 micron sieve.

5. A method as claimed in claim 1 wherein the cube strength of the filling material is not less than 1.5 MPa after 7 days.

6. A method as claimed in claim 5 wherein the cube strength is not less than 4.0 MPa after 28 days.

7. A method as claimed in claim 1 wherein the filler has a sorptive action on radioelements leaching from the waste.

8. A method as claimed in claim 1 wherein the filler has a fineness such as to maintain stability of the slurry.

9. A method as claimed in claim 1 wherein the filler is limestone flour.

10. A method as claimed in claim 9 wherein the proportions of the slurry are approximately 35.5% water, 26% portland cement, 10% lime, and 28.5% limestone flour, all percentages being by weight.

11. A method as claimed in claim 1 wherein the slurry is prepared by adding the ingredients to a mixer in the following order: water, cement, lime, filler.

12. A method as claimed in claim 1 wherein the filling material has a buffering capacity such that, for deionized ground water discharging at a rate of $10^{-10}$ meter per second uniformly into one face of a one meter cube of the filling material, the column of water emerging from the opposite face is buffered at pH 10.5 or above for a column length of $2.5\times10^{3}$ meters over a period of $10^{5}$ years or longer.

13. A method as claimed in claim 1 wherein the filling material has a hydraulic conductivity at 28 days cured in a sealed condition of between $10^{-8}$ to $10^{-10}$ meter per second.

14. A method as claimed in claim 1 wherein the filling material has a fractional porosity in the range 0.4 to 0.6.

15. A method as claimed in claim 1 wherein the filling material has a pore radius distribution in the range $1\times10^{-3}$ to 1 micron.

16. A method of forming a repository for radioactive waste comprising locating the waste in a subterranean vault and backfilling the vault with a filling material which is water permeable and provides a substantial reservoir of available alkalinity such that any ground water permeating through the filling material to the waste has a pH of at least 10.5, wherein the filling material is cementitious and is prepared as a slurry to backfill voids in the vault and then allowed to cure to form said filling material as a weakly bound material having cube compressive strength at any age up to 50 years of not more than about 15 MPa.

17. A method as claimed in claim 16 wherein the vault is excavated.

18. A method as claimed in claim 16 wherein the cementitious slurry uses a filler which has a fineness such that at least 50% passes through a 150 micron sieve.

19. A method as claimed in claim 18 wherein the fineness of the filler is such that at least 80% passes through a 150 micron sieve.

20. A method as claimed in claim 16 wherein the cube strength of the filling material is not less than 1.5 MPa after 7 days.

21. A method as claimed in claim 20 wherein the cube strength is not less than 4.0 MPa after 28 days.

22. A method as claimed in claim 16 wherein the filling material contains calcium hydroxide and calcium silicate hydrate gel formed by hydration of at least one of portland cement and lime.

23. A method as claimed in claim 16 wherein the filling material has a buffering capacity such that, for deionized ground water discharging at a rate of $10^{-10}$ meter per second uniformly into one face of a one meter cube of the filling material, the column of water emerging from the opposite face is buffered at pH 10.5 or above for a column length of $2.5\times10^{3}$ meters over a period of $10^{5}$ years or longer.

24. A method as claimed in claim 16 wherein the filling material has a hydraulic conductivity at 28 days cured in a sealed condition of between $10^{-8}$ to $10^{-10}$ per meter per second.

25. A method as claimed in claim 16 wherein the filling material has a fractional porosity in the range 0.4 to 0.6.

26. A method as claimed in claim 16 wherein the filling material has a pore radius distribution in the range $1\times10^{-3}$ to 1 micron.

27. A method of forming a repository for radioactive waste comprising locating the waste in a subterranean vault and backfilling the vault with a filling material which is water permeable and provides a substantial reservoir of available alkalinity such that any ground water permeating through the filling material to the waste has a pH of at least 10.5, wherein the filling material has a buffering capacity such that, for deionized ground water discharging at a rate of $10^{-10}$ meter per second uniformly into one face of a one meter cube of the filling material, the column of water emerging from the opposite face is buffered at pH 10.5 or above for a column length of $2.5\times10^{3}$ meters over a period of $10^{5}$ years or longer.

28. A method as claimed in claim 27 wherein the vault is excavated.

29. A method as claimed in claim 27 wherein the filling material contains calcium hydroxide and calcium silicate hydrate gel formed by hydration of at least one of portland cement and lime.

30. A method as claimed in claim 27 wherein the filling material has a hydraulic conductivity at 28 days cured in a sealed condition of between $10^{-8}$ to $10^{-10}$ meter per second.

31. A method as claimed in claim 27 wherein the filling material has a fractional porosity in the range 0.4 to 0.6.

32. A method as claimed in claim 27 wherein the filling material has a pore radius distribution in the range $1\times10^{-3}$ to 1 micron.

33. A method of forming a repository for radioactive waste comprising locating the waste in a subterranean vault and backfilling the vault with a filling material which is water permeable and provides a substantial reservoir of available alkalinity such that any ground water permeating through the filling material to the waste has a pH of at least 10.5, wherein the filling material has a fractional porosity in the range 0.4 to 0.6.

34. A method as claimed in claim 33 wherein the vault is excavated.

35. A method as claimed in claim 33 wherein the filling material has a pore radius distribution in the range $1\times10^{-3}$ to 1 micron.

36. A cementitious filling material prepared as a slurry comprising 30 to 40% water, 20 to 30% portland cement, 7 to 15% lime and 20 to 40% filler, all percentages being by weight.

37. The filling material of claim 36 wherein the filler is limestone flour.

38. The filling material of claim 37 wherein the proportions of the slurry are approximately 35.5% water, 26% portland cement, 10% lime, and 28.5% limestone flour, all percentages being by weight.

* * * * *